US005297828A

United States Patent [19]

Chung

[11] Patent Number: 5,297,828

[45] Date of Patent: Mar. 29, 1994

[54] VEHICLE TRUNK LID SECURING APPARATUS

[76] Inventor: Thomas I. Chung, 7955 Dunbrook Rd., Suite A, San Diego, Calif. 92126

[21] Appl. No.: 999,126

[22] Filed: Dec. 31, 1992

[51] Int. Cl.[5] ..... E05C 19/18

[52] U.S. Cl. ..... 292/258; 292/262

[58] Field of Search ..... 292/258, 259, 262, 288, 292/339

[56] References Cited

U.S. PATENT DOCUMENTS

| | | | |
|---|---|---|---|
| 2,618,497 | 11/1952 | Gordels | 292/288 X |
| 2,908,522 | 10/1959 | Glave | 292/288 |
| 2,919,946 | 1/1960 | Miener | 292/288 |
| 2,973,217 | 2/1961 | Gregoire | 292/288 |
| 3,117,689 | 1/1964 | Dedic, Sr. | 292/262 |
| 3,180,668 | 4/1965 | Brown | 292/276 |
| 3,328,064 | 6/1967 | Simon | 292/288 |
| 3,589,760 | 6/1971 | Williams | 292/288 X |
| 3,891,257 | 6/1975 | Wilson | 292/262 |
| 3,971,589 | 7/1976 | Elrod | 292/262 X |
| 4,191,413 | 3/1980 | Barner | 292/262 |
| 4,593,946 | 6/1986 | Rich | 292/262 X |
| 4,659,122 | 4/1987 | Miller | 292/262 |
| 4,666,194 | 5/1987 | Charman | 292/288 |
| 4,976,371 | 12/1990 | Wise et al. | 292/288 X |

*Primary Examiner*—Richard E. Moore

*Attorney, Agent, or Firm*—John R. Flanagan

[57] ABSTRACT

A vehicle trunk lid securing apparatus includes an elongated flexible inelastic strap and first and second connectors connected to the strap. The first connector includes a base ring through which is looped a portion of the strap and a releasable snap hook being rotatably mounted to the base ring and adapted to releasably attach to a hook of a trunk lid locking mechanism. The second connector includes an elongated handle portion and a rigid wire loop insert portion attached to an end of the handle portion and being operable to attach to a latch of the trunk lid locking mechanism by gripping the handle portion and pulling on the strap toward the latch. The apparatus also includes a cam-type buckle mechanism operable for adjusting the effective length of the strap to establish a set distance between the first and second connectors which matches the distance between the hook and latch of the trunk lid locking mechanism. The cam buckle mechanism has a body receiving a pair of sections of the strap therethrough and a cam lever actuatable relative to the body between an open unclamping condition and a closed clamping condition to respectively release the strap sections for movement relative to one another and restrain the strap sections from undergoing movement relative to one another.

20 Claims, 1 Drawing Sheet

FIG. 1
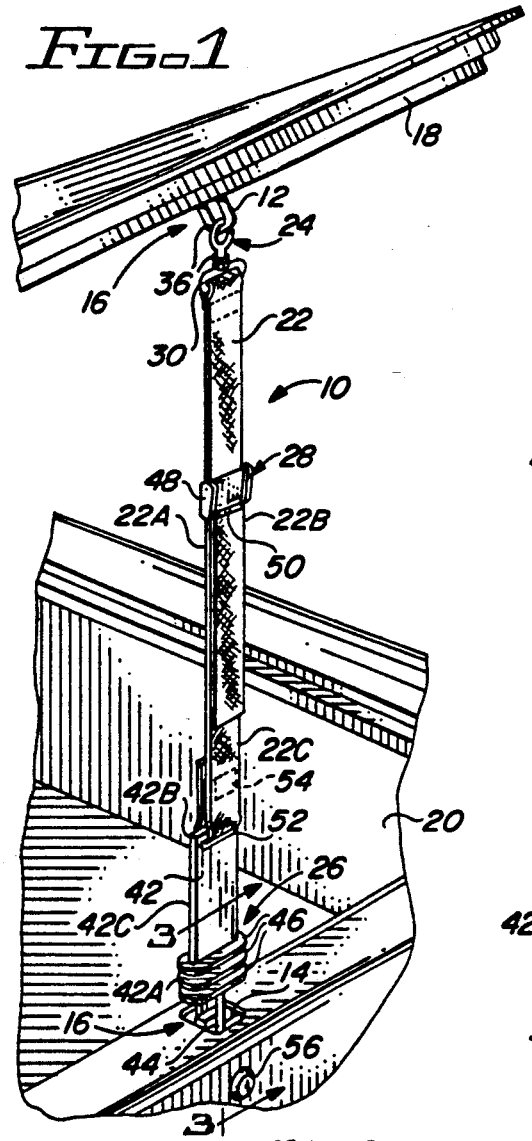
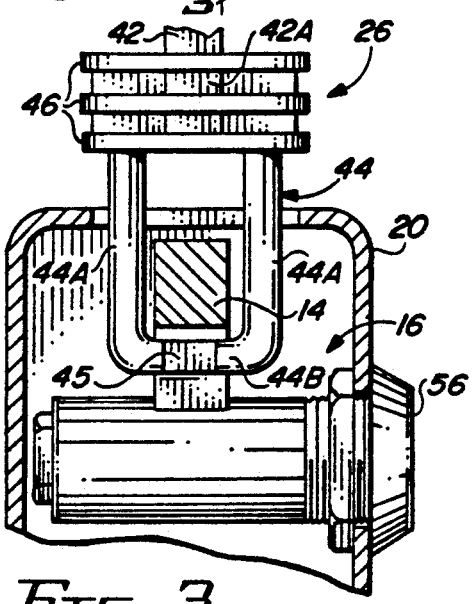
FIG. 3
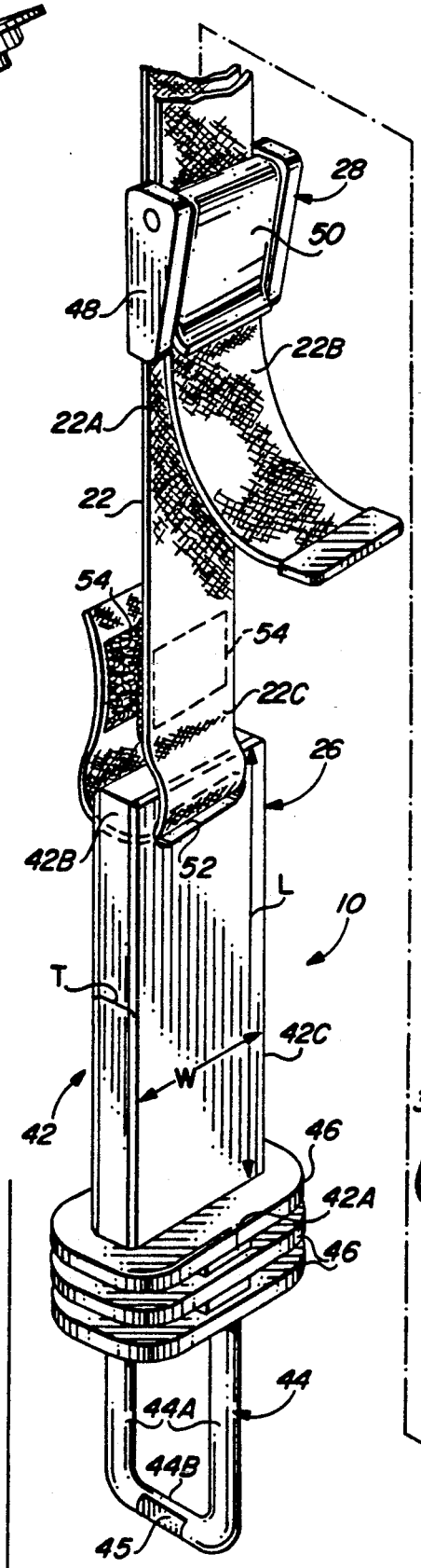
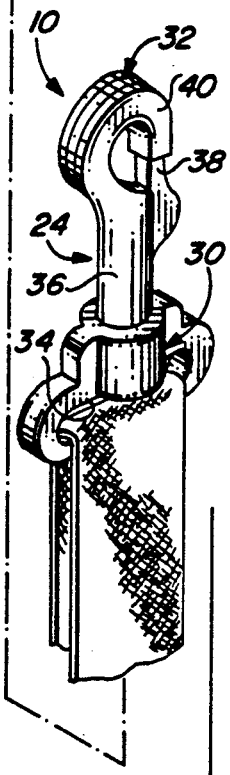
FIG. 2

VEHICLE TRUNK LID SECURING APPARATUS

BACKGROUND OF THE INVENTION

1. Field of the Invention

The present invention generally relates to vehicle trunk lid fastening devices and, more particularly, is concerned with a vehicle trunk lid securing apparatus which employs the hook and latch of an existing trunk lid locking mechanism.

2. Description of the Prior Art

It is well-known that occasionally things have to be carried in the trunk compartment of a car which are too large or bulky to permit the complete closing of the trunk lid. The term "trunk lid" as used herein is meant to also include a conventional hatchback lid.

In order to prevent the trunk lid from blocking the rear view of the driver, it is useful to employ a device to tie down the lid in order to prevent it from bouncing up and down. Representative examples of some devices used for this purpose are the ones disclosed in U.S. patents to Glave (U.S. Pat. No. 2,908,522), Miener (U.S. Pat. No. 2,919,946), Gregoire (U.S. Pat. No. 2,973,217), Dedic, Sr. (U.S. Pat. No. 3,117,689), Brown (U.S. Pat. No. 3,180,668), Simon (U.S. Pat. No. 3,328,064), Wilson (U.S. Pat. No. 3,891,257), Barner (U.S. Pat. No. 4,191,413) and Miller (U.S. Pat. No. 4,659,122). A drawback shared by all of these devices is that they require suitable features such as holes or projections to be available in the trunk lid and trunk compartment for attaching and anchoring these devices thereto. These devices appear to be awkward to use and thus unsatisfactory.

Another device for use in tying down a trunk lid is disclosed in U.S. Pat. No. 4,666,194 to Charman. The Charman device overcomes the above-described drawback of the other devices by utilizing the existing hook or striker and latch of the trunk lid locking mechanism as the features for connecting the device between the trunk lid and trunk compartment. The Charman device includes an elongated webbing strap with a buckle for adjusting its length, an openable clasp at one end of the strap, and a keeper at the opposite end of the strap. The one end of the strap is threaded through the clasp. The clasp has a hook portion, a loop portion through which the strap passes, and a tongue portion engaging the inside of the hook portion. The keeper is an assembly of a pair of spaced plates with central openings and a plurality of cylindrical pins of different diameters extending between corners of the spaced plates. The openable clasp is for engaging with the hook or striker of the trunk lid locking mechanism and the keeper is for engaging with the latch of the trunk lid locking mechanism which is then restored to its latched condition. The keeper can be rotated within a loop of the strap to bring any one of the cylindrical pins into line with the strap.

However, the Charman device appears to be too complicated in construction and too awkward to use and thus unsatisfactory. Consequently, a need still exists for improvement of the construction of trunk lid fastening devices so as to overcome the drawbacks of the prior art without substituting new ones in their place.

SUMMARY OF THE INVENTION

The present invention provides a trunk lid securing apparatus designed to satisfy the aforementioned need. On the one hand, like the prior art Charman device, the trunk lid securing apparatus of the present invention employs the hook and latch of the existing trunk lid locking mechanism to connect the apparatus between the trunk lid and trunk compartment. On the other hand, unlike the prior art Charman device, the trunk lid securing apparatus of the present invention has an improved and simpler construction which is much more user-friendly.

Accordingly, the present invention is directed to a trunk lid securing apparatus which comprises: (a) an elongated flexible strap; (b) a first connector connected to the elongated flexible strap and being operable to attach to a hook of a trunk lid locking mechanism; (c) a second connector connected to the elongated flexible strap, the second connector including an elongated handle portion and an insert portion attached to an end of the handle portion and being operable to attach to a latch of the trunk lid locking mechanism by gripping the handle portion and pulling on the strap toward the latch; and (d) means for adjusting the effective length of the elongated flexible strap to establish a set distance between the first and second connectors which matches the distance between the hook and latch of the trunk lid locking mechanism.

Also, the first connector includes a base ring through which is looped a portion of the elongated flexible strap and a releasable snap hook rotatably mounted to the base ring and adapted to releasably attach to the hook of the trunk lid locking mechanism. The second connector also includes an annular stop portion surrounding and extending transversely outwardly from the handle portion adjacent to the end thereof.

Further, the insert portion of the second connector is preferably a rigid wire loop having a pair of legs attached to and extending longitudinally from the end of the handle portion and a bight spaced from the end of the handle portion and extending between and attached to the legs. The handle portion of the second connector is a generally flat member having a longitudinal length, a transverse width and a transverse thickness. The longitudinal length is substantially greater than the transverse width and thickness.

More particularly, the strap adjusting means is a cam buckle mechanism having a body and a cam lever pivotally mounted to the body. The body receives a pair of sections of the elongated flexible strap therethrough. The cam lever is actuatable relative to the body between an open unclamping condition and a closed clamping condition to respectively release the strap sections for movement relative to one another and restrain the strap sections from undergoing movement relative to one another. Also, the elongated flexible strap has an end portion connected to one of the first and second connectors by being looped therethrough. The end portion of the elongated flexible strap has a pair of patches of complementary hook and loop detachable fastening material applied on a surface thereof and facing toward one another so as to provide a detachable attachment between overlapped sections of the end portion of the elongated flexible strap.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following description, reference will be made to the attached drawings in which:

FIG. 1 is a perspective view of a trunk lid securing apparatus of the present invention connected between a hook and latch of an existing trunk lid locking mechanism to connect the apparatus between the trunk lid and trunk compartment.

FIG. 2 is an enlarged foreshortened perspective view of the trunk lid securing apparatus of the present invention.

FIG. 3 is an enlarged fragmentary elevational view of one end of the trunk lid securing apparatus connected to the latch of the trunk lid locking mechanism.

DETAILED DESCRIPTION OF THE INVENTION

Referring to the drawings and particularly to FIG. 1, there is illustrated a trunk lid securing apparatus of the present invention, generally designated 10. The trunk lid securing apparatus 10 is connected between a hook (or striker) 12 and a latch 14 making up an existing trunk lid locking mechanism 16 respectively installed on the trunk lid 18 and trunk compartment 20 of the vehicle with which the securing apparatus 10 is being employed.

Basically, the trunk lid securing apparatus 10 includes an elongated flexible strap 22 fabricated of a substantially inelastic material, such as nylon webbing, a first connector 24 connected to the flexible strap 22 and being operable to attach to the hook 12 of the trunk lid locking mechanism 16, a second connector 26 connected to the flexible strap 22 and operable to attach to the latch 14 of the trunk lid locking mechanism 16, and means in the form of a cam-type buckle mechanism 28 operable for adjusting the effective length of the flexible strap 22 to establish a set distance between the first and second connectors 24, 26 which 26 which matches the distance between the hook and latch 12, 14 of the trunk lid locking mechanism 16.

Referring to FIG. 2, the first connector 24 of the securing apparatus 10 includes a base ring 30 and a releasable snap hook 32. The base ring 30 has an oblong slot 34 through which is looped a portion of the flexible strap 22. The snap hook 32 has an elongated stem 36 rotatably mounted to the base ring 30 and a latch finger 38 slidably mounted to the stem portion 36 for movement, between a closed position (FIG. 2) and an opened position, toward and away from an arcuate hook portion 40 on the outer end of the stem 36. The latch finger 38, internally of the stem 36, is spring biased toward the closed position but is yieldably slidably movable to the opened position thereby adapting the snap hook 24 to be readily and easily releasably attached to the hook 12 of the trunk lid locking mechanism 16.

Referring to FIGS. 2 and 3, the second connector 26 of the securing apparatus 10 includes an elongated handle portion 42 and an insert 44 attached to an end 42A of the handle portion 42. The handle portion has an opposite end 42B and an elongated gripping section 42C connected to and extending in a substantially linear relationship between the opposite ends 42A, 42B. The handle portion 42 is a generally flat member fabricated of molded plastic material and having a longitudinal length L, a transverse width W and a transverse thickness T. The longitudinal length L is substantially greater than the transverse width W and transverse thickness T. The insert portion 44 is preferably in the configuration of a rod-shaped rigid metallic wire loop having a pair of legs 44A attached to and extending longitudinally from the end 42A of the handle portion 42 and a bight 44B spaced from the end 42A of the handle portion 42 and extending between and attached to the legs 44A. The bight 44B has a pair of recessed flat lands 45 formed on opposite sides thereof The wire loop insert portion 44 preferably has an U-shaped configuration although other configurations, such as V-shape or J-shape are possible. The insert portion 44 is operable to attach to the latch 14 of the trunk lid locking mechanism 16 by gripping the handle portion 42 and pulling on the flexible strap 22 toward the latch 14. When attached together, the latch 14 extends between the legs 44A and overlies the bight 44B of the insert portion 44. The handle portion 42 of the second connector 26 also includes an annular stop 46 rigidly attached to, surrounding and extending transversely outwardly from the end 42A of the handle portion 42. The legs 44A of the insert portion 44 are rigidly embedded in opposite sides of the stop 46.

The cam buckle mechanism 28 of the securing apparatus 10 has a body 48 and a cam lever 50 pivotally mounted to the body 48. The body 48 receives a pair of sections 22A, 22B of the flexible strap therethrough in a side-by-side relationship. The cam lever 50 is actuated relative to the body 48 by being pivotally moved toward and away from the body 48 between an opened unclamping condition and a closed clamping condition (FIG. 2). In the opened unclamping condition, the cam lever 50 releases the strap sections 22A, 22B for movement relative to one another to thereby adjust the effective length of the strap 22. In the closed clamping condition of FIG. 2, the cam lever 50 restrains the strap sections 22A, 22B from undergoing movement relative to one another to thereby set the effective length of the strap 22 and the distance between the first and second connectors 24, 26.

Also, the flexible strap 22 has an end portion 22C connected to either one of the first and second connectors 24, 26 by being looped therethrough. In the illustrated embodiment, the end portion 22C of the flexible strap 22 is looped through a slot 52 in the opposite end 42B of the handle portion 42. The end portion 22C of the flexible strap 22 can have a pair of patches 54 of complementary hook and loop detachable fastening material applied on a surface thereof and facing toward one another so as to provide a detachable attachment between overlapped sections of the end portion 22C of the flexible strap 22. Alter the overlapped sections of the end portion 22C of the flexible strap 22 can be permanently attached together, such as by stitching, or a D-shaped ring can be employed to releasably attach the end portion 22C to itself.

In summary, the securing apparatus 10 of the present invention relates to a tie-down device for securing a vehicle trunk lid 18 (including a hatchback lid) to the trunk compartment 20 when an oversized cargo is carried therein. The wire loop insert portion 44 snap fits with the latch 14 of the trunk lid locking mechanism 16 in the same manner as does the vehicle's own hook of the trunk lid locking mechanism 16.

To install the securing apparatus 10, the snap hook 32 of the first connector 24 and the insert portion 44 of the second connector 26 are respectively attached to the hook 12 and latch 14 of the trunk lid locking mechanism 16. With the cam lever 50 in the opened condition, the cam buckle mechanism 28 is then operated to adjust the effective length of the strap 22 to remove the slack and match the desired distance between the hook 12 and latch 14. Thereafter, the cam lever 50 is closed to retain the strap 22 at the desired effective length.

To release the securing apparatus 10, the vehicle's trunk key is inserted into the keyhole 56 of the trunk lid locking mechanism 16 and turned to cause the latch 14 of the trunk lid locking mechanism 16 to release the insert portion 44 of the second connector 26. Then, the snap hook 32 of the first connector 24 is detached from the hook 12 of the trunk lid locking mechanism 16.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A vehicle trunk lid securing apparatus, comprising:

(a) an elongated flexible strap;

(b) a first connector connected to said elongated flexible strap and being operable to attach to a hook of a trunk lid locking mechanism, (c) a second connector connected to said elongated flexible strap, said second connector including an elongated handle portion having a pair of opposite ends and an elongated gripping section connected to and extending in a substantially linear relationship between said opposite ends, said second connector also including an insert portion attached to one of said opposite ends of said handle portion and being operable to attach to a latch of the trunk lid locking mechanism by gripping said substantially linear elongated gripping section of said handle portion and pulling on said strap toward the latch, said strap being connected to the other of said opposite ends of said handle portion; and (d) means for adjusting the effective length of said elongated flexible strap to establish a set distance between said first and second connectors which matches the distance between the hook and latch of the trunk lid locking mechanism.

2. The apparatus of claim 1 wherein said handle portion of said second connector is a generally flat member having a longitudinal length, a transverse width and a transverse thickness, said longitudinal length being substantially greater than said transverse width and thickness.

3. The apparatus of claim 1 wherein said elongated flexible strap has an end portion connected to one of said first connector and said second connector by being looped therethrough, said end portion of said elongated flexible strap having overlapped sections and means connecting said overlapped sections of said end portion to one another.

4. A vehicle trunk lid securing apparatus, comprising:

(a) an elongated flexible strap;

(b) a first connector connected to said elongated flexible strap and being operable to attach to a hook of a trunk lid locking mechanism;

(c) a second connector connected to said elongated flexible strap, said second connector including an elongated handle portion and a rigid wire loop insert portion attached to an end of said handle portion and being operable to attach to a latch of the trunk lid locking mechanism by gripping said handle portion and pulling on said strap toward the latch; and (d) means for adjusting the effective length of said elongated flexible strap to establish a set distance between said first and second connectors which matches the distance between the hook and latch of the trunk lid locking mechanism, said strap adjusting means being a cam buckle mechanism having a body receiving a pair of sections of said elongated flexible strap therethrough, said cam buckle mechanism also having a cam lever pivotally mounted to said body and being actuatable relative thereto between an open unclamping condition and a closed clamping condition to respectively release said strap sections for movement relative to one another and restrain said strap sections from undergoing movement relative to one another.

5. The apparatus of claim 4 wherein said handle portion of said second connector also includes an annular stop surrounding and extending transversely outwardly from said end of said handle portion.

6. The apparatus of claim 4 wherein said first connector includes:

a base ring through which is looped a portion of said elongated flexible strap; and a releasable snap hook being rotatably mounted to said base ring and adapted to releasably attach to the hook of the trunk lid locking mechanism.

7. The apparatus of claim 4 wherein said wire loop insert portion of said second connector has a pair of legs attached to and extending longitudinally from said end of said handle portion and a bight spaced from said end of said handle portion and extending between and attached to said legs.

8. The apparatus of claim 4 wherein said wire loop insert portion of said second connector is an elongated rod-shaped element formed in a U-shaped configuration.

9. The apparatus of claim 4 said handle portion of said second connector is a generally flat member having a longitudinal length, a transverse width and a transverse thickness, said longitudinal length being substantially greater than said transverse width and thickness.

10. The apparatus of claim 4 wherein said elongated flexible strap has an end portion connected to one of said first connector and said second connector by being looped therethrough, said end portion of said elongated flexible strap having overlapped sections and means releasably connecting said overlapped sections of said end portion to one another.

11. A vehicle trunk lid securing apparatus, comprising:

(a) an elongated flexible substantially inelastic strap;

(b) a first connector connected to said elongated flexible strap and being operable to attach to a hook of a trunk lid locking mechanism, said first connector including a base ring through which is looped a portion of said elongated flexible strap and a releasable snap hook being rotatably mounted to said base ring and adapted to releasably attach to the hook of the trunk lid locking mechanism;

(c) a second connector connected to said elongated flexible strap, said second connector including an elongated handle portion having an annular stop surrounding and extending transversely outwardly from an end of said handle portion, said second connector also including an insert portion attached to said end of said handle portion and being operable to attach to a latch of the trunk lid locking mechanism by gripping said handle portion and pulling on said strap toward the latch; and (d) means for adjusting the effective length of said elongated flexible strap to establish a set distance between said first and second connectors which matches the distance between the hook and latch of the trunk lid locking mechanism, said strap adjusting means being a cam buckle mechanism having a body receiving a pair of sections of said elongated flexible strap therethrough, said cam buckle mechanism also having a cam lever pivotally mounted to said body and being actuatable relative thereto between an open unclamping condition and a closed clamping condition to respectively release said strap sections for movement relative to one another and restrain said strap sections from undergoing movement relative to one another.

12. The apparatus of claim 11 wherein said insert portion of said second connector has a pair of legs attached to and extending longitudinally from said end of said handle portion and a bight spaced from said end of said handle portion and extending between and attached to said legs.

13. The apparatus of claim 11 wherein said insert portion of said second connector is an elongated rod-shaped element formed in a U-shaped configuration.

14. The apparatus of claim 11 wherein said handle portion of said second connector is a generally flat member having a longitudinal length, a transverse width and a transverse thickness, said longitudinal length being substantially greater than said transverse width and thickness.

15. The apparatus of claim 11 wherein said elongated flexible strap has one end portion connected to one of said first connector and said second connector by being looped therethrough, said one end portion of said elongated flexible strap having a pair of patches of complementary hook and loop detachable fastening material applied on a surface thereof and facing toward one another so as to provide a detachable attachment between overlapped sections of said one end portion of said elongated flexible strap.

16. A vehicle trunk lid securing apparatus, comprising:

(a) an elongated flexible strap;

(b) a first connector connected to said elongated flexible strap and being operable to attach to a hook of a trunk lid locking mechanism;

(c) a second connector connected to said elongated flexible strap, said second connector including an elongated handle portion and an insert portion attached to an end of said handle portion and being operable to attach to a latch of the trunk lid locking mechanism by gripping said handle portion and pulling on said strap toward the latch; and (d) means for adjusting the effective length of said elongated flexible strap to establish a set distance between said first and second connectors which matches the distance between the hook and latch of the trunk lid locking mechanism;

(e) said handle portion of said second connector also including an annular stop surrounding and extending transversely outwardly from said end of said handle portion.

17. A vehicle trunk lid securing apparatus, comprising:

(a) an elongated flexible strap;

(b) a first connector connected to said elongated flexible strap and being operable to attach to a hook of a trunk lid locking mechanism;

(c) a second connector connected to said elongated flexible strap, said second connector including an elongated handle portion and an insert portion attached to an end of said handle portion and being operable to attach to a latch of the trunk lid locking mechanism by gripping said handle portion and pulling on said strap toward the latch; and (d) means for adjusting the effective length of said elongated flexible strap to establish a set distance between said first and second connectors which matches the distance between the hook and latch of the trunk lid locking mechanism;

(e) said first connector including a base ring through which is looped a portion of said elongated flexible strap and a releasable snap hook being rotatably mounted to said base ring and adapted to releasably attach to the hook of the trunk lid locking mechanism.

18. A vehicle trunk lid securing apparatus, comprising:

(a) an elongated flexible strap;

(b) a first connector connected to said elongated flexible strap and being operable to attach to a hook of a trunk lid locking mechanism;

(c) a second connector connected to said elongated flexible strap, said second connector including an elongated handle portion and an insert portion attached to an end of said handle portion and being operable to attach to a latch of the trunk lid locking mechanism by gripping said handle portion and pulling on said strap toward the latch; and (d) means for adjusting the effective length of said elongated flexible strap to establish a set distance between said first and second connectors which matches the distance between the hook and latch of the trunk lid locking mechanism;

(e) said insert portion of said second connector having a pair of legs attached to and extending longitudinally from said end of said handle portion and a bight spaced from said end of said handle portion and extending between and attached to said legs.

19. A vehicle trunk lid securing apparatus, comprising:

(a) an elongated flexible strap;

(b) a first connector connected to said elongated flexible strap and being operable to attach to a hook of a trunk lid locking mechanism;

(c) a second connector connected to said elongated flexible strap, said second connector including an elongated handle portion and an insert portion attached to an end of said handle portion and being operable to attach to a latch of the trunk lid locking mechanism by gripping said handle portion and pulling on said strap toward the latch; and (d) means for adjusting the effective length of said elongated flexible strap to establish a set distance between said first and second connectors which matches the distance between the hook and latch of the trunk lid locking mechanism;

(e) said insert portion of said second connector being an elongated rod-shaped element formed in an U-shaped configuration.

20. A vehicle trunk lid securing apparatus, comprising:

(a) an elongated flexible strap;

(b) a first connector connected to said elongated flexible strap and being operable to attach to a hook of a trunk lid locking mechanism;

(c) a second connector connected to said elongated flexible strap, said second connector including an elongated handle portion and an insert portion attached to an end of said handle portion and being operable to attach to a latch of the trunk lid locking mechanism by gripping said handle portion and pulling on said strap toward the latch; and (d) means for adjusting the effective length of said elongated flexible strap to establish a set distance between said first and second connectors which matches the distance between the hook and latch of the trunk lid locking mechanism;

(e) said strap adjusting means being a cam buckle mechanism having a body receiving a pair of sections of said elongated flexible strap therethrough, said cam buckle mechanism also having a cam lever pivotally mounted to said body and being actuatable relative thereto between an open unclamping condition and a closed clamping condition to respectively release said strap sections for movement relative to one another and restrain said strap sections from undergoing movement relative to one another.

* * * * *